US010621929B2

(12) United States Patent
Shan

(10) Patent No.: US 10,621,929 B2
(45) Date of Patent: Apr. 14, 2020

(54) DRIVING METHOD AND APPARATUS FOR DISPLAY APPARATUS

(71) Applicant: HKC CORPORATION LIMITED, Shenzhen (CN)

(72) Inventor: Jianfeng Shan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 240 days.

(21) Appl. No.: 15/750,672

(22) PCT Filed: Dec. 15, 2017

(86) PCT No.: PCT/CN2017/116323

§ 371 (c)(1),
(2) Date: Feb. 6, 2018

(87) PCT Pub. No.: WO2019/085181

PCT Pub. Date: May 9, 2019

(65) Prior Publication Data

US 2020/0027409 A1 Jan. 23, 2020

(30) Foreign Application Priority Data

Nov. 3, 2017 (CN) ..... 2017 1 1069361

(51) Int. Cl.
*G09G 3/36* (2006.01)

(52) U.S. Cl.
CPC ... *G09G 3/3607* (2013.01); *G09G 2320/0242* (2013.01); *G09G 2320/0666* (2013.01)

(58) Field of Classification Search
CPC .... G09G 3/003; G09G 3/2003; G09G 3/3413; G09G 3/3607; G09G 3/3611;
(Continued)

(56) References Cited

U.S. PATENT DOCUMENTS

2004/0155837 A1 8/2004 Yu et al.
2006/0114205 A1 6/2006 Shen et al.
(Continued)

FOREIGN PATENT DOCUMENTS

CN 100568326 C 12/2009
CN 102509541 A 6/2012
(Continued)

OTHER PUBLICATIONS

Shan, International Application No. PCT/CN2017/115246, filed on Dec. 8, 2017 and English Translation thereof.
(Continued)

*Primary Examiner* — Nelson M Rosario
(74) *Attorney, Agent, or Firm* — Kagan Binder, PLLC

(57) ABSTRACT

A driving method and an apparatus for a display apparatus, the driving method includes: acquiring a target color scheme to be adjusted; acquiring original gray scale display voltages corresponding to the target color scheme in an input signal and color cast gray scale display voltages corresponding to a color cast generated in the target color scheme; deleting parts of the original gray scale display voltages corresponding to the target color scheme and less than the color cast gray scale display voltages, thus obtaining map gray scale display voltages corresponding to the target color scheme; distributing the original gray scale display voltages corresponding to the target color scheme to the map gray scale display voltages corresponding to the target color scheme.

18 Claims, 5 Drawing Sheets

(58) Field of Classification Search
CPC ..... G09G 3/3406; G09G 3/3648; G09G 2300/0426; G09G 2310/0235; G09G 2310/08; G09G 2320/0252; G09G 2320/0285; G09G 2340/16; H04N 13/324; H04N 13/349
See application file for complete search history.

(56) References Cited

U.S. PATENT DOCUMENTS

| | | | | |
|---|---|---|---|---|
| 2009/0079682 | A1 | 3/2009 | Yamato et al. | |
| 2013/0222436 | A1 | 8/2013 | Park et al. | |
| 2013/0300778 | A1 | 11/2013 | Hsieh | |
| 2016/0104444 | A1* | 4/2016 | Miyata ..... | G09G 3/3406 345/205 |
| 2018/0053474 | A1* | 2/2018 | Miyata ..... | G09G 3/3413 |

FOREIGN PATENT DOCUMENTS

| | | | |
|---|---|---|---|
| CN | 102752608 | A | 10/2012 |
| CN | 103106884 | A | 5/2013 |
| CN | 103268759 | A | 8/2013 |
| CN | 104021767 | A | 9/2014 |
| CN | 104658502 | A | 5/2015 |
| CN | 106157869 | A | 11/2016 |

OTHER PUBLICATIONS

Shan, International Application No. PCT/CN2017/115264, filed on Dec. 8, 2017 and English Translation thereof.
Shan, International Application No. PCT/CN2017/115165, filed on Dec. 8, 2017 and English Translation thereof.
Shan, International Application No. PCT/CN2017/115289, filed on Dec. 8, 2017 and English Translation thereof.
International Search Report for International Application No. PCT/CN2017/116323, dated Jul. 19, 2018 (3 pages).
Office Action for Chinese Application No. 201711069361.1, dated Apr. 18, 2019 (6 pages).

* cited by examiner

DRIVING METHOD AND APPARATUS FOR DISPLAY APPARATUS

CROSS-REFERENCE TO RELATED APPLICATION

This application claims priority to Chinese Patent Application No. 2017110693611, entitled "DRIVING METHOD AND APPARATUS FOR DISPLAY APPARATUS" filed Nov. 3, 2017, the contents of which are expressly incorporated by reference herein in its entirety.

FIELD OF THE INVENTION

The present disclosure relates to a field of display technology, and particularly relates to a driving method and apparatus for a display apparatus.

BACKGROUND OF THE INVENTION

For a liquid crystal displayer (LCD), due to the relevance between refractive index and wavelength, the transmittance of different wavelengths is related to the phase delay, which shows different degrees of performance of the transmittance and the wavelength. Also, with the change of voltage drive, different wavelength phase delays will also have varying degrees of changes that impact the transmittance of different wavelengths.

Taking the characteristics of Vertical Alignment (VA) mode display as an example, when the voltage drive is changed from a high voltage to a low voltage, the color chroma is obviously affected. Specifically, the color saturation is bright while the voltage is high, and the color brightness drops when the voltage is driven down. Taking an 8-bit display that can display different gray scales from 0 to 255 as an example, the saturation at high gray scales is quite bright, while the color brightness drops at low gray scales.

SUMMARY OF THE INVENTION

Accordingly, in order to address the problem of the defective color casted image quality, it is necessary to provide a driving method and a driving apparatus for a display apparatus are provided, which can effectively improve the color casted image quality.

A driving method for a display apparatus includes:

acquiring a target color scheme to be adjusted;

acquiring original gray scale display voltages corresponding to the target color scheme in an input signal and color cast gray scale display voltages corresponding to a color cast generated in the target color scheme;

deleting parts of the original gray scale display voltages corresponding to the target color scheme and less than the color cast gray scale display voltages, thus obtaining map gray scale display voltages corresponding to the target color scheme; and distributing the original gray scale display voltages corresponding to the target color scheme to the map gray scale display voltages corresponding to the target color scheme.

According to an embodiment, the target color scheme is a solid color, prior to the step of distributing the original gray scale display voltages corresponding to the target color scheme to the map gray scale display voltages corresponding to the target color scheme further includes:

acquiring the original gray scale display voltages corresponding to each color scheme;

deleting parts of the original gray scale display voltages corresponding to each of the color schemes and less than the color cast gray scale display voltages, thus obtaining map gray scale display voltages corresponding to each of the color schemes;

The step of distributing the original gray scale display voltages corresponding to the target color scheme to the map gray scale display voltages corresponding to the target color scheme includes:

distributing the original gray scale display voltages corresponding to each of the color schemes to the map gray scale display voltages corresponding to each of the color schemes.

According to an embodiment, the step of acquiring the color cast gray scale display voltages corresponding to the color cast generated in the target color scheme includes:

acquiring a chroma variation profile of the target color scheme; and acquiring the color cast gray scale display voltages corresponding to the color cast generated in the target color scheme and according to the chroma variation profile.

According to an embodiment, an increased display voltage for each gray scale in the map gray scale display voltages corresponding to the target color scheme is a difference of the display voltages between a current gray scale and a previous gray scale in the original gray scale corresponding to the target color scheme.

According to an embodiment, the step of acquiring the target color scheme to be adjusted includes:

acquiring color cast data corresponding to each color scheme in the input signal; and regarding a color with a greatest color cast value as the target color scheme.

According to an embodiment, the step of acquiring the target color scheme to be adjusted includes:

acquiring color cast data corresponding to each color scheme in the input signal; and regarding a color with a smallest color cast value as the target color scheme.

According to an embodiment, the step of acquiring the target color scheme to be adjusted includes:

acquiring color cast data corresponding to each color scheme in the input signal; and regarding a color with the greatest color cast value and a color with the second greatest color cast value as the target color scheme.

A driving apparatus for a display apparatus includes:

a color scheme selecting module configured to acquire a target color scheme to be adjusted;

a gray scale voltage acquiring module configured to acquire original gray scale display voltages corresponding to the target color scheme in an input signal and color cast gray scale display voltages corresponding to a color cast generated in the target color scheme;

a gray scale voltage mapping module configured to delete a part of the original gray scale display voltages corresponding to the target color scheme and less than the color cast gray scale display voltages, thus obtain map gray scale display voltages corresponding to the target color scheme; and a gray scale voltage distributing module configured to distribute the original gray scale display voltages corresponding to the target color scheme to the map gray scale display voltages corresponding to the target color scheme.

According to an embodiment, the target color scheme is a solid color, the gray scale voltage mapping module is configured to acquire the original gray scale display voltages corresponding to each color scheme in the input signal, delete parts of the original gray scale display voltages corresponding to each of the color schemes and less than the color cast gray scale display voltages, thus obtain the map gray scale display voltages corresponding to each of the color schemes; the gray scale voltage mapping module is configured to distribute the original gray scale display voltages corresponding to each of the color schemes to the map gray scale display voltages corresponding to each of the color schemes.

According to an embodiment, the color scheme selecting module includes:

an acquiring unit configured to acquire color cast data corresponding to each of the color schemes in the input signal; and a selecting unit configured to regard a color with a smallest color cast value as the target color scheme.

According to an embodiment, the color scheme selecting module includes:

an acquiring unit configured to acquire color cast data corresponding to each of the color schemes in the input signal; and a selecting unite configured to regard a color with a greatest color cast value as the target color scheme.

According to an embodiment, the color scheme selecting module includes:

an acquiring unit configured to acquire color cast data corresponding to each of the color schemes in the input signal; and a selecting unite configured to regard a color with a greatest color cast value and a color with a second greatest color cast value as the target color schemes.

According to an embodiment, the gray scale acquiring module is configured to acquire a chroma variation profile of the target color scheme, and acquire the color cast gray scale display voltages corresponding to the color cast generated in the target color scheme according to the chroma variation profile.

According to an embodiment, the target color scheme is the solid color, the gray scale voltage mapping module is configured to acquire the original gray scale display voltages corresponding to each of the color schemes, delete parts of the original gray scale display voltages corresponding to each of the color schemes and less than the color cast gray scale display voltages, thus obtain map gray scale display voltages corresponding to each of the color schemes;

acquiring color cast data corresponding to each color scheme in an input signal;

regarding a color with a least color cast value as a target color scheme, or, regarding a color with a greatest color cast value as a target color scheme, or regarding a color with the greatest color cast value and a color with the second greatest color cast value as target color schemes, and the target color scheme is a solid color;

acquiring original gray scale display voltages corresponding to the target color scheme in an input signal and color cast gray scale display voltages corresponding to a color cast generated in the target color scheme;

acquiring original gray scale display voltages corresponding to each of the color schemes in the input signal;

deleting parts of the original gray scale display voltages corresponding to the each of the color schemes and less than the color cast gray scale display voltages, thus obtaining map gray scale display voltages corresponding to each of the color schemes; and distributing the original gray scale display voltages corresponding to each of the color schemes to the map gray scale display voltages, where an increased display voltage in the map gray scale display voltages corresponding to the target color scheme is a difference of the display voltages between the current gray scale and the previous gray scale in the original gray scale corresponding to the target color scheme In the driving method and apparatus for a display apparatus according to present disclosure, a target color scheme to be adjusted is acquired, original gray scale displays voltage corresponding to the target color in an input signal and cast gray scale display voltages corresponding to a color cast generated in the target color scheme are acquired, parts of the original gray scale display voltages corresponding to the target color scheme and less than the color cast gray scale display voltages are deleted and map gray scale voltages are acquired, then the original gray scale display voltages corresponding to the target color scheme are distributed to the map gray scale display voltages corresponding to the target color scheme. During the whole progress, the low gray scales that affect the color brightness in the target color scheme is deleted, such that the color casted image quality for the display apparatus is effectively improved.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

The above objects, features and advantages of the present invention will become more apparent by describing in detail embodiments thereof with reference to the accompanying drawings. It should be understood that no limitation of the scope of the disclosure is thereby intended.

For a display apparatus (for example, an LCD), due to the relevance between refractive index and wavelength, the transmittance of different wavelengths is related to the phase delay, which shows different degrees of performances of the transmittance and the wavelength. Also, with the change of voltage drive, different wavelength phase delay will also have varying degrees of changes that impact the transmittance of different wavelengths. For example, in CIE (International Commission on Illumination) 1976 chroma diagram, in terms of the characteristics of VA mode display, when the voltage drive is changed from high voltage to low voltage, the color chroma is apparently affected. Specifically, the color saturation is quite bright while the voltage is high, and the color brightness drops when the voltage is driven down. In other words, for an 8 bit display that can display different gray scales from 0 to 255, the saturation at high gray scales is quite bright, while the color brightness drops at low gray scales.

Figure 1:
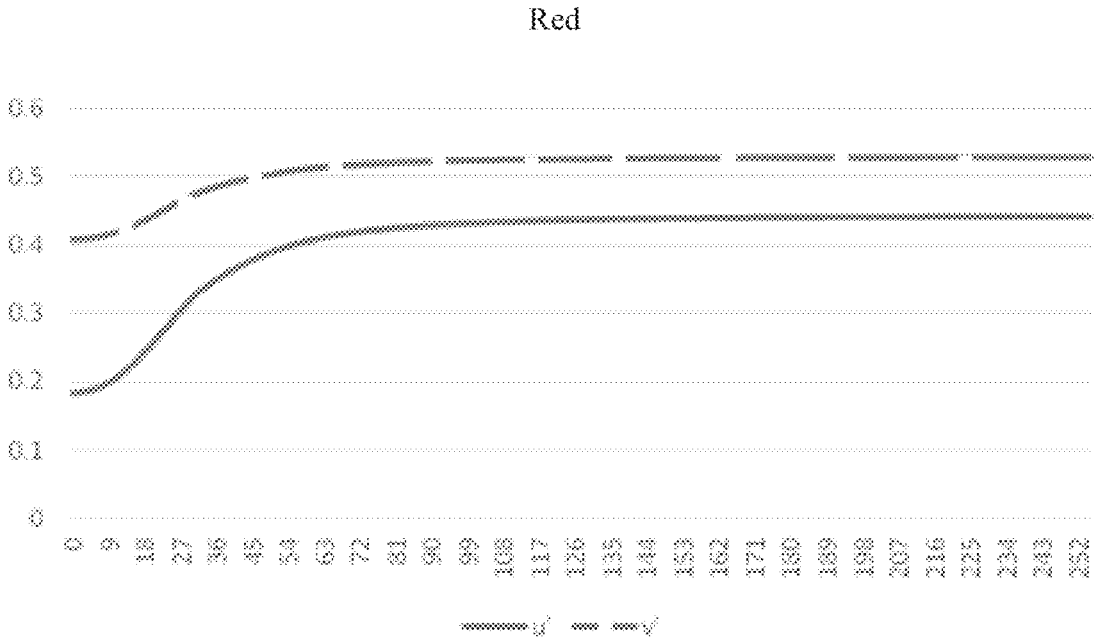
FIG. 1 is a schematic view of a chroma variation profile of red.
Figure 2:
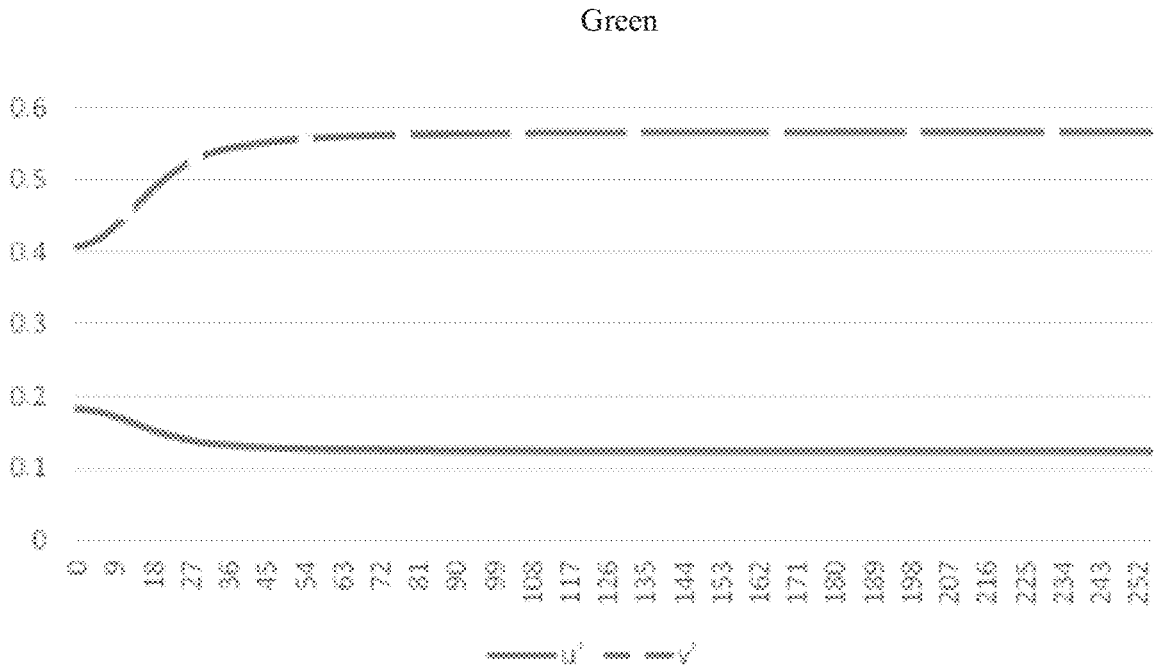
FIG. 2 is a schematic view of a chroma variation profile of green.
Figure 3:
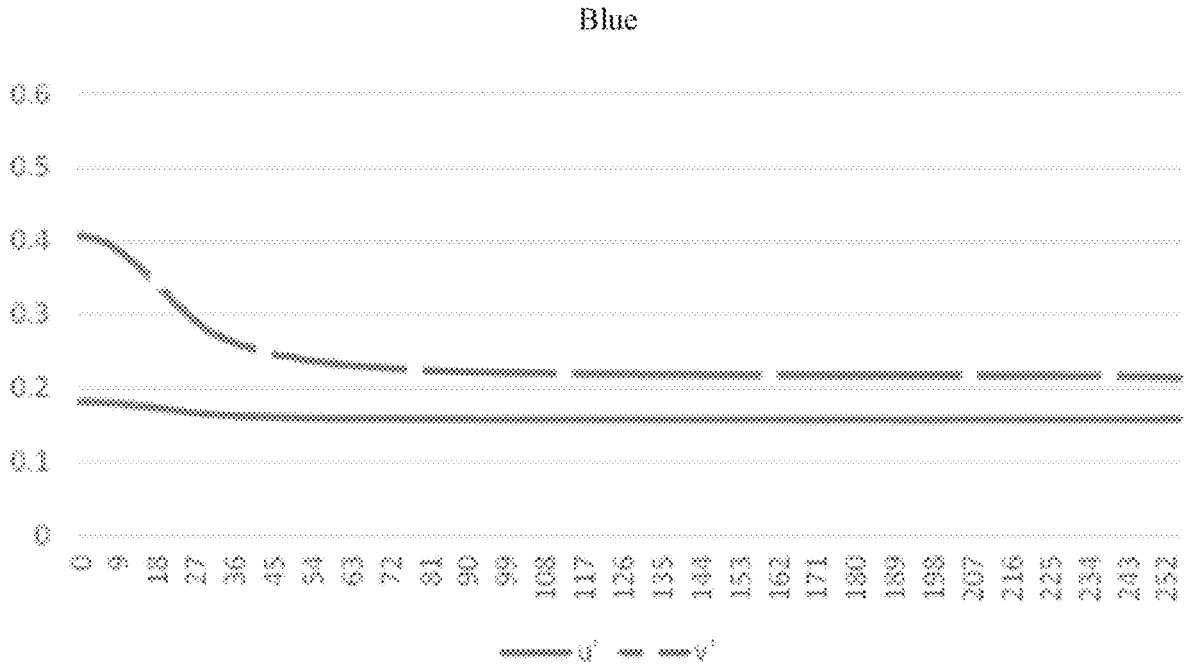
FIG. 3 is a schematic view of a chroma variation profile of blue.
Figure 4:
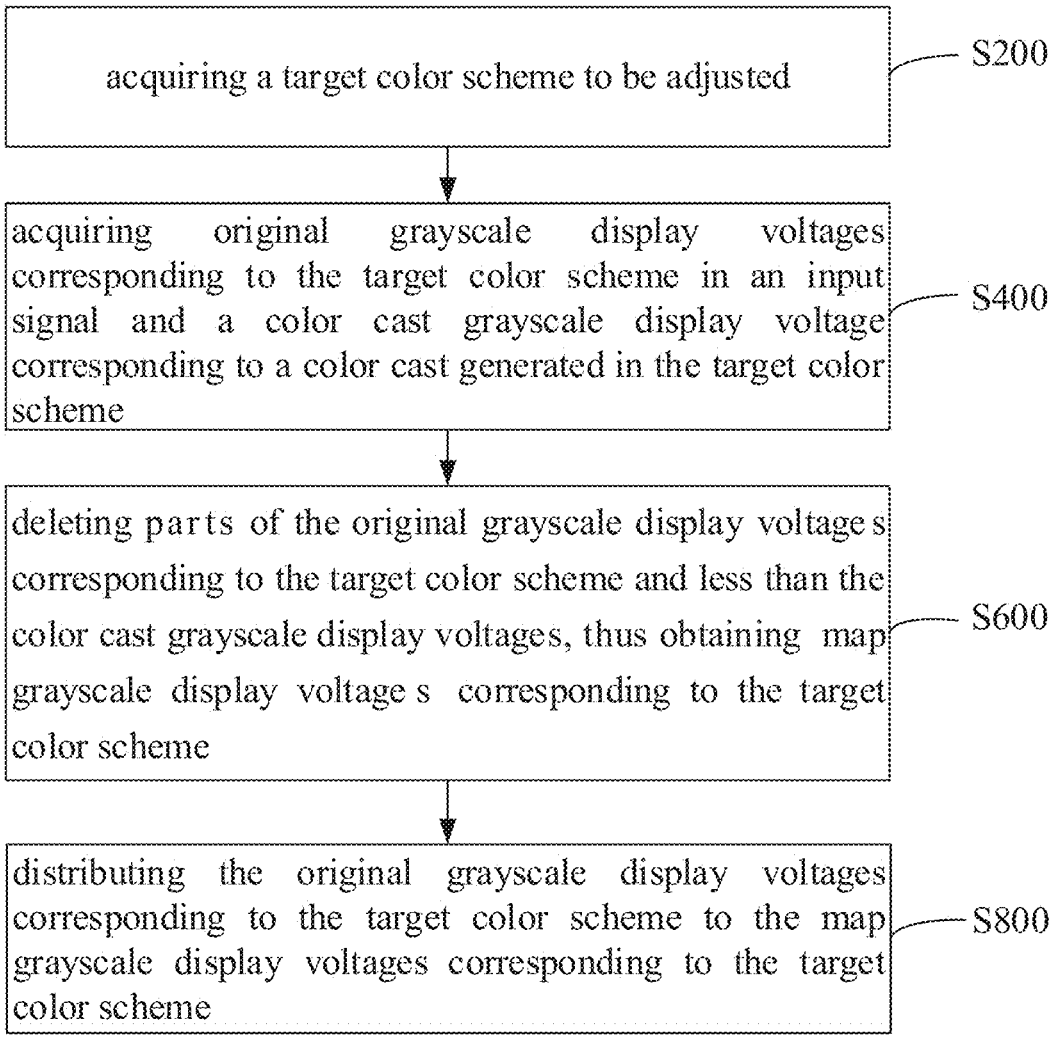
FIG. 4 is a schematic flow chart of a driving method for a display apparatus according to an embodiment of the present disclosure.

In further studies, referring to FIG. 1, FIG. 2, and FIG. 3, when a V-T curve of a panel is designed in the published version 2.2, RGB (red, green, blue) respectively varies the CIE 1976 chroma. It can be observed that at the gray scale 56, the color brightness of R starts to drop due to the different phase relay ratio and the GB sub-pixel light leakage; at the gray scale 32, the color brightness of G starts to drop due to the different phase relay ratio and the RB sub-pixel light leakage; and at the gray scale 60, the color brightness of B starts to drop due to the different phase relay ratio and the RG sub-pixel light leakage. In further studies, the drop of color brightness of each RGB color is also reflected at the viewing angle observation. The varying trend of each color brightness of RGB, over the gray scales and observed horizontally from a 60 degree, is of a same case from a front view angle, the saturation at high voltage is quite bright, while the color brightness drops when the voltage is driven down.

In further studies, for the color cast variation of a display apparatus in large angle and front view angle in each representative color schemes, it is clearly found that color schemes biased to R, G, B colors have severer color casts than other color schemes in large view angle. Therefore, addressing the color cast defects in R, G, and color B can significantly increase the improvement of overall color cast in large angle of view.

Referring to FIG. 3, a driving method for a display apparatus includes steps of:

S200: a target color scheme to be adjusted is acquired.

The target color scheme can be selected according to the actual situation, or be selected with reference to color casts corresponding to each of the color schemes. As previously described, the color schemes biased to R, G, and B colors have severer color casts than other color schemes in large angle of view. Therefore, fixing the color cast defects in color R, G, and B can significantly improve the overall color cast in large angle of view. In other words, part or all of colors form color R, G, and B can be selected as the target color scheme. Furthermore, referring to the color casts corresponding to the color R, G, and B, a color with the most severe color cast or with the least severe color cast can be selected as the target color scheme.

S400: original gray scale display voltages corresponding to the target color scheme in an input signal and color cast gray scale display voltage corresponding to a color cast generated in the target color scheme are acquired.

The gray scale is a variation of luminance between the darkest and the brightest that divided into certain portions, so as to facilitate the control of the screen luminance corresponding to the input signal. The original gray scale in the input signal is related to the performance of the display apparatus. For example, an 8-bit display has 28 original gray scales corresponding to its color schemes, in other words, it has 0 to 255 gray scales. Therefore, for the 8-bit display, the original gray scales corresponding to the target color scheme in the input signal are from 0 to 255.

Since the gray scale display voltage is in correspondence with the gray scale, the color cast gray scale display voltage corresponding to generated color cast is acquired by acquiring the color cast gray scale corresponding to the generated color cast. As previously described, the color cast is generated at a low gray scale, and each kind of colors has a threshold gray scale of color cast, the gray scales under the threshold gray scale are gray scales corresponding to the generated color cast. Particularly, referring to FIG. 1, FIG. 2, and FIG. 3, it can be observed from FIG. 1, FIG. 2, and FIG. 3 that, at the gray scale 56, the color brightness of R starts to drop due to the different phase relay ratio and the GB sub-pixel light leakage. In other words, the threshold gray scale of color R that generates a color cast is 56, the gray scales corresponding to generated color cast are from 0 to 55. In other words, the gray scales 0 to 55 are the color cast gray scales (low gray scales) of color R. At the gray scale 32, the color brightness of G starts to drop due to the different phase relay ratio and the RB sub-pixel light leakage, therefore the threshold gray scale of G color that generates a color cast is 32, the gray scales corresponding to generated color cast are from 0 to 31. And at the gray scale 60, the color brightness of B starts to drop due to the different phase relay ratio and the RG sub-pixel light leakage, therefore the threshold gray scale of color B that generates a color cast is 60, the gray scales corresponding to generated color cast are from 0 to 59. Each gray scale has a corresponding gray scale display voltage, in previously described examples, the original gray scales of color R are from 0 to 255, so its original gray scale display voltages are from V0 to V255, the color cast gray scale is from 0 to 55, and the color cast gray scale display voltages are from V0 to V55. The original gray scale of G color is from 0 to 255, so its original gray scale display voltages are from V0 to V255, the color cast gray scale is from 0 to 29, and the color cast gray scale display voltages are from V0 to V29. The original gray scale of color B is from 0 to 255, so its original gray scale display voltages are from V0 to V255, the color cast gray scale is from 0 to 59, and the color cast gray scale display voltages are from V0 to V59.

S600: parts of the original gray scale display voltages corresponding to the target color scheme and less than the color cast gray scale display voltages are deleted, thus map gray scale display voltages corresponding to the target color scheme are obtained.

Particularly, if the target color scheme acquired from S200 is color B, the original gray scale voltages of color B acquired from S400 are from V0 to V255, the color cast gray scale display voltages are from V0 to V59, then in S600, the part of the original gray scale display voltages from V0 to V255 whose color cast gray scale display voltages are from V0 to V59 are deleted, thus the map gray scale display voltages from V60 to V255 corresponding to the improved color scheme of color B are acquired. For the improvement of display of color R or color G, the process is similar to the previously described process and is omitted for brevity. More particularly, the process is adjusted and designed specifically to the 8-bit RBG gray scales display color (display gray scale 0 to 255) of the LCD, when the input signal is from 0 to 255, an LUT (Look-Up-Table) is established according to the color cast variation trend in R, G, and B display, (after the data is pre-wrote by the LUT into the storage medium, every inputting of a signal is very much inputting an address to look up the table, the content corresponding to the address is found and output), such that the gray scales likely to cause color cast are removed from the low gray scales.

S800: the original gray scale display voltages corresponding to the target color scheme are distributed to the map gray scale display voltages corresponding to the target color scheme.

Particularly, in this distributing process, an increased display voltage for each of the gray scale in the map gray scale display voltages is a difference of the display voltages between a current gray scale and a previous gray scale in the original gray scale corresponding to the target color scheme. In other words, the current gray scale display voltage in the map gray scale=initial value of the map gray scale display voltage of color+(previous gray scale display voltage in the original gray scale—current gray scale display voltage in the original gray scale).

The previously described relationship will be described in detail with reference to specific embodiments and tables of detailed data. If the target color scheme acquired from S200 is color B, the original gray scale voltages of color B and acquired from S400 are from V0 to V255, the color cast gray scale display voltages are from V0 to V59, in S600, the parts of the original gray scale display voltages from V0 to V255 whose color cast gray scale display voltages are from V0 to V59 are deleted, thus the map gray scale display voltages from V60 to V255 corresponding to the improved color scheme of color B are acquired. Then in S800, the original gray scale display voltages from V0 to V255 corresponding to the improved color scheme of color B are redistributed to the map gray scale display voltages from V60 to V255. Particularly, the initial value of the map gray scale display voltage corresponding to the target color scheme of color B is V60, the max value is V255, and for the values between V60 and V255, each increased display voltage for each gray scales is the difference of the display voltages between the current gray scale and the previous gray scale in the original gray scale corresponding to the target color scheme of color B. In other words, suppose the original gray scale display voltage of the target color scheme B in the input signal is V1, the corresponding map gray scale display voltage is V60+(V1-V1), and so on. The following TABLE 1 can be referred to for details.

TABLE 1 is the corresponding relationship between the original gray scale display voltage and the map gray scale display voltage in color schemes.

In the driving method display apparatus according to present disclosure, a target color scheme to be adjusted is acquired, original gray scale display voltages corresponding to the target color in an input signal and cast gray scale display voltages corresponding to a color cast generated in the target color scheme are acquired, parts of the original gray scale display voltages corresponding to the target color scheme and less than the color cast gray scale display voltages are deleted and map gray scale voltages are obtained, then the original gray scale display voltages corresponding to the target color scheme are distributed to the map gray scale display voltages corresponding to the target color scheme. During the whole progress, the low gray scales that affect the color brightness in the target color scheme is deleted, such that the color casted image quality for a display apparatus is effectively improved.

According to an embodiment, the step of acquiring color cast gray scale display voltages corresponding to a color cast generated in the target color scheme includes:

acquiring a chroma variation profile of the target color scheme; and acquiring color cast gray scale display voltages corresponding to the color cast generated in the target color scheme according to the chroma variation profile.

The details of the chroma variation profile can be seen from FIG. 1, FIG. 2, and FIG. 3. In view of the curve, the color cast gray scales corresponding to each of the color schemes can be precisely acquired, in other words, the color cast gray scales corresponding to the color cast generated in the target color scheme. The chroma variation profile can be obtained from historical experience data and experimental data.

According to an embodiment, the step of acquiring the target color scheme to be adjusted includes:

acquiring color cast data corresponding to each color scheme; and regarding a color with a greatest color cast value as the target color scheme.

| Input | Original Gray scale Display Voltage | | | Map Gray scale Display Voltage | | |
|---|---|---|---|---|---|---|
| Signal | R | G | B | R | G | B |
| 0 | V0 | V0 | V0 | V56 | V32 | V60 |
| 1 | V1 | V1 | V1 | V56 + (V1 − V0) | V32 + (V1 − V0) | V60 + (V1 − V0) |
| 2 | V2 | V2 | V2 | V56 + (V2 − V1) | V32 + (V2 − V1) | V60 + (V2 − V1) |
| 3 | V3 | V3 | V3 | V56 + (V3 − V2) | V32 + (V3 − V2) | V60 + (V3 − V2) |
| 4 | V4 | V4 | V4 | V56 + (V4 − V3) | V32 + (V4 − V3) | V60 + (V4 − V3) |
| 5 | V5 | V5 | V5 | V56 + (V5 − V4) | V32 + (V5 − V4) | V60 + (V5 − V4) |
| 6 | V6 | V6 | V6 | V56 + (V6 − V5) | V32 + (V6 − V5) | V60 + (V6 − V5) |
| 7 | V7 | V7 | V7 | V56 + (V7 − V6) | V32 + (V7 − V6) | V60 + (V7 − V6) |
| 8 | V8 | V8 | V8 | V56 + (V8 − V7) | V32 + (V8 − V7) | V60 + (V8 − V7) |
| 9 | V9 | V9 | V9 | V56 + (V9 − V8) | V32 + (V9 − V8) | V60 + (V9 − V8) |
| . | . | . | . | . | . | . |
| . | . | . | . | . | . | . |
| . | . | . | . | . | . | . |
| 244 | V244 | V244 | V244 | V56 + (V244 − V243) | V32 + (V244 − V243) | V60 + (V244 − V243) |
| 245 | V245 | V245 | V245 | V56 + (V245 − V244) | V32 + (V245 − V244) | V60 + (V245 − V244) |
| 246 | V246 | V246 | V246 | V56 + (V246 − V245) | V32 + (V246 − V245) | V60 + (V246 − V245) |
| 247 | V247 | V247 | V247 | V56 + (V247 − V246) | V32 + (V247 − V246) | V60 + (V247 − V246) |
| 248 | V248 | V248 | V248 | V56 + (V248 − V247) | V32 + (V248 − V247) | V60 + (V248 − V247) |
| 249 | V249 | V249 | V249 | V56 + (V249 − V248) | V32 + (V249 − V248) | V60 + (V249 − V248) |
| 250 | V250 | V250 | V250 | V56 + (V250 − V249) | V32 + (V250 − V249) | V60 + (V250 − V249) |
| 251 | V251 | V251 | V251 | V56 + (V251 − V250) | V32 + (V251 − V250) | V60 + (V251 − V250) |
| 252 | V252 | V252 | V252 | V56 + (V252 − V251) | V32 + (V252 − V251) | V60 + (V252 − V251) |
| 253 | V253 | V253 | V253 | V56 + (V253 − V252) | V32 + (V253 − V252) | V60 + (V253 − V252) |
| 254 | V254 | V254 | V254 | V56 + (V254 − V253) | V32 + (V254 − V253) | V60 + (V254 − V253) |
| 255 | V255 | V255 | V255 | V255 | V255 | V255 |

According to an embodiment, the step of acquiring the target color scheme to be adjusted includes:

acquiring color cast data corresponding to each of the color schemes in the input signal; and regarding a color with a smallest color cast value as the target color scheme.

The color cast value is a parameter value representing a level of color cast, the greater the color cast value is, the severer the color cast is, on the other hand, the less the color cast value is, the least severe the color cast is. Here, in view of the color cast data in the input signal, the color cast values corresponding to each of the color schemes may be sorted in descending order or in ascending order, so as to obtain a color cast sequence of each of the color schemes, then the color with a greatest color cast value (the most severe color cast), or the color with a smallest color cast value (the least severe color cast) is selected.

According to an embodiment, the step of acquiring the target color scheme to be adjusted includes:

acquiring color cast data corresponding to each of the color schemes; and regarding a color with the greatest color cast value and a color with the second greatest color cast value as the target color schemes.

The color cast data corresponding to each of the color schemes in the input signal can be acquired according to the chroma variation profile. The color with the second greatest color cast value is a color with a second most severe color cast. For example, for color red, green, and blue, the color cast sequence in a descending order of each of the color schemes is red, green, and blue, then the color with the greatest color cast value is red, and the color cast in red is the most severe; the color with the second greatest color cast value is green, and the color cast in green is the second most severe; the color with the smallest color cast value is blue, and the color cast in blue is the least severe.

According to an embodiment, the target color scheme is the solid color, prior to the step of distributing the original gray scale display voltages corresponding to the target color scheme to the map gray scale display voltages corresponding to the target color scheme further includes:

acquiring the original gray scale display voltages corresponding to each of the color schemes; and deleting the parts of the original gray scale display voltages corresponding to each of the color schemes and less than the color cast gray scale display voltages, thus obtaining map gray scale display voltages corresponding to each of the color schemes.

The step of distributing the original gray scale display voltages corresponding to the target color scheme to the map gray scale display voltages corresponding to the target color scheme includes:

distributing the original gray scale display voltages corresponding to each of the color schemes to the map gray scale display voltages corresponding to each of the color schemes.

In the illustrated embodiment, in addition to adjusting the gray scale display voltages of the target color scheme, the original gray scale display voltages of each of the color schemes (excluding the target color scheme) in the input signal are also adjusted. Particularly, the adjustment can be aligning the original gray scales display voltages in non-target color schemes with the map gray scale display voltages corresponding to the target color scheme. In other words, parts of the original gray scale display voltages that are less than the color cast gray scale display voltage are deleted, so as to obtain map gray scale display voltages corresponding to the target color scheme.

Taking the target color scheme being color B as an example, assuming that the color schemes in the input signal further includes color R and color G, the original gray scale display voltages are from V0 to V 255, according to FIG. 1, FIG. 2, FIG. 3, and TABLE 1, the color cast gray scale display voltages of color B s are from V0 to V59, then the map gray scale display voltages of color B are from V60 to V255. In the illustrated embodiment, for the other color schemes (color R and color G) in the input signal, the other color schemes (color R and color G) are aligned with the map gray scale display voltages from V60 to V255. In other words, the parts of the original gray scale display voltages of color R and color G (V0 to V255) that are less than the color cast gray scale display voltages of color B (V0 to V 59) are deleted, then the obtained map gray scale display voltages of color R are from V60 to V255, and the obtained map gray scale display voltages of color G are from V60 to V255, then the original gray scale display voltages from V0 to V255 of each of the color schemes are redistributed to the map gray scale display voltages from V60 to V255.

According to an embodiment, the target scheme is the solid color, the driving method for the display apparatus includes:

acquiring the color cast data corresponding to each of the color schemes in the input signal;

regarding a color with a smallest color cast value as the target color scheme, regarding or, a color with a greatest color cast value as the target color scheme, or regarding a color with the greatest color cast value and a color with the second greatest color cast value as the target color schemes;

acquiring the original gray scale display voltages corresponding to the target color scheme in an input signal and the color cast gray scale display voltages corresponding to a color cast generated in the target color scheme;

acquiring the original gray scale display voltages corresponding to each of the color schemes in the input signal;

deleting parts of the original gray scale display voltages corresponding to each of the color scheme and are less than the color cast gray scale display voltages are deleted, thus obtaining map gray scale display voltages corresponding to each of the color schemes; and distributing the original gray scale display voltages corresponding to each of the color schemes to the map gray scale display voltages corresponding to each of the color schemes.

To illustrate the technical solutions of the driving method for a display apparatus according to the embodiments of the present invention clearly, the specific examples of application and detailed data are introduced.

The color schemes to be improved includes color R, color G, and color B.

According to FIG. 1, FIG. 2, and FIG. 3, it can be observed that the color cast gray scale display voltages of color R are from V0 to V55, the color cast gray scale display voltages of color G are from V0 to V29, and the color cast gray scale display voltages of color B are from V0 to V59. The original gray scale display voltages of each of the color schemes in the input signal are from V0 to V255, the part of original gray scale display voltage corresponding to the target color scheme that is less than the color cast gray scale display voltage is deleted, then the map gray scale display voltages of color R are from V56 to V 255, the map gray scale display voltages of color G are from V32 to V 255, and the map gray scale display voltages of color B are from V60 to V 255. Then the original gray scale display voltages of each of the color schemes are distributed to the map gray scale display voltages, specifically, for the color R, the original gray scale display voltages from V0 to V255 are redistributed to the map gray scale display voltages from V56 to V255; for the color G, the original gray scale display voltage from V0 to V255 are redistributed to the map gray scale display voltages from V32 to V255; for the color B, the original gray scale display voltages from V0 to V255 are redistributed to the map gray scale display voltages from V60 to V255. Referring to TABLE. 1, for each of the color schemes, during the distributing progress, the increased display voltage for each gray scales in map gray scale display voltages is the difference of the display voltages between the current gray scale and the previous gray scale in the original gray scale corresponding to the target color scheme.

The color scheme to be improved is a solid color with the most severe color cast, color B:

The solid color with the most severe color cast is aligned, particularly, the color B that has the most severe color cast is aligned. The parts of the original gray scale display voltages of each of the color schemes that are less than the color cast gray scale display corresponding to color B are deleted, then the obtained map gray scale display voltages of each of the color schemes are from V60 to V255, then the original gray scale display voltages from V0 to V255 are redistributed to the map gray scale display voltages from V60 to V255. The following TABLE 2 can be referred to for details.

TABLE 2 is the relationship between the original gray scale display voltage of each of the color schemes and the map gray scale display voltage while the solid color with the most severe color cast is aligned.

| Input | Original gray scale display voltage | | | Map gray scale display voltage | | |
|---|---|---|---|---|---|---|
| signal | R | G | B | R | G | B |
| 0 | V0 | V0 | V0 | V60 | V60 | V60 |
| 1 | V1 | V1 | V1 | V60 + (V1 − V0) | V60 + (V1 − V0) | V60 + (V1 − V0) |
| 2 | V2 | V2 | V2 | V60 + (V2 − V1) | V60 + (V2 − V1) | V60 + (V2 − V1) |
| 3 | V3 | V3 | V3 | V60 + (V3 − V2) | V60 + (V3 − V2) | V60 + (V3 − V2) |
| 4 | V4 | V4 | V4 | V60 + (V4 − V3) | V60 + (V4 − V3) | V60 + (V4 − V3) |
| 5 | V5 | V5 | V5 | V60 + (V5 − V4) | V60 + (V5 − V4) | V60 + (V5 − V4) |
| 6 | V6 | V6 | V6 | V60 + (V6 − V5) | V60 + (V6 − V5) | V60 + (V6 − V5) |
| 7 | V7 | V7 | V7 | V60 + (V7 − V6) | V60 + (V7 − V6) | V60 + (V7 − V6) |
| 8 | V8 | V8 | V8 | V60 + (V8 − V7) | V60 + (V8 − V7) | V60 + (V8 − V7) |
| 9 | V9 | V9 | V9 | V60 + (V9 − V8) | V60 + (V9 − V8) | V60 + (V9 − V8) |
| . | . | . | . | . | . | . |
| . | . | . | . | . | . | . |
| . | . | . | . | . | . | . |
| 244 | V244 | V244 | V244 | V60 + (V244 − V243) | V60 + (V244 − V243) | V60 + (V244 − V243) |
| 245 | V245 | V245 | V245 | V60 + (V245 − V244) | V60 + (V245 − V244) | V60 + (V245 − V244) |
| 246 | V246 | V246 | V246 | V60 + (V246 − V245) | V60 + (V246 − V245) | V60 + (V246 − V245) |
| 247 | V247 | V247 | V247 | V60 + (V247 − V246) | V60 + (V247 − V246) | V60 + (V247 − V246) |
| 248 | V248 | V248 | V248 | V60 + (V248 − V247) | V60 + (V248 − V247) | V60 + (V248 − V247) |
| 249 | V249 | V249 | V249 | V60 + (V249 − V248) | V60 + (V249 − V248) | V60 + (V249 − V248) |
| 250 | V250 | V250 | V250 | V60 + (V250 − V249) | V60 + (V250 − V249) | V60 + (V250 − V249) |
| 251 | V251 | V251 | V251 | V60 + (V251 − V250) | V60 + (V251 − V250) | V60 + (V251 − V250) |
| 252 | V252 | V252 | V252 | V60 + (V252 − V251) | V60 + (V252 − V251) | V60 + (V252 − V251) |
| 253 | V253 | V253 | V253 | V60 + (V253 − V252) | V60 + (V253 − V252) | V60 + (V253 − V252) |
| 254 | V254 | V254 | V254 | V60 + (V254 − V253) | V60 + (V254 − V253) | V60 + (V254 − V253) |
| 255 | V255 | V255 | V255 | V255 | V255 | V255 |

The color scheme to be improved is a solid color with the least severe color cast, color G:

The solid color with the least severe color cast is aligned, particularly, the color G that has the least severe color cast is aligned. The parts of the original gray scale display voltages of each of the color schemes that are less than the color cast gray scale display corresponding to color G are deleted, then the obtained map gray scale display voltages of each of the color schemes are from V32 to V255, then the original gray scale display voltages V0 to V255 are redistributed to the map gray scale display voltages from V32 to V255. The following TABLE 3 can be referred to for details.

TABLE 3 is the relationship between the original gray scale display voltage of each of the color schemes and the map gray scale display voltage while the solid color with the least severe color cast is aligned.

| Input | Original gray scale display voltage | | | Map gray scale display voltage | | |
|---|---|---|---|---|---|---|
| signal | R | G | B | R | G | B |
| 0 | V0 | V0 | V0 | V32 | V32 | V32 |
| 1 | V1 | V1 | V1 | V32 + (V1 − V0) | V32 + (V1 − V0) | V32 + (V1 − V0) |
| 2 | V2 | V2 | V2 | V32 + (V2 − V1) | V32 + (V2 − V1) | V32 + (V2 − V1) |
| 3 | V3 | V3 | V3 | V32 + (V3 − V2) | V32 + (V3 − V2) | V32 + (V3 − V2) |
| 4 | V4 | V4 | V4 | V32 + (V4 − V3) | V32 + (V4 − V3) | V32 + (V4 − V3) |
| 5 | V5 | V5 | V5 | V32 + (V5 − V4) | V32 + (V5 − V4) | V32 + (V5 − V4) |

-continued

| Input signal | Original gray scale display voltage R | G | B | Map gray scale display voltage R | G | B |
|---|---|---|---|---|---|---|
| 6 | V6 | V6 | V6 | V32 + (V6 − V5) | V32 + (V6 − V5) | V32 + (V6 − V5) |
| 7 | V7 | V7 | V7 | V32 + (V7 − V6) | V32 + (V7 − V6) | V32 + (V7 − V6) |
| 8 | V8 | V8 | V8 | V32 + (V8 − V7) | V32 + (V8 − V7) | V32 + (V8 − V7) |
| 9 | V9 | V9 | V9 | V32 + (V9 − V8) | V32 + (V9 − V8) | V32 + (V9 − V8) |
| . | . | . | . | . | . | . |
| . | . | . | . | . | . | . |
| . | . | . | . | . | . | . |
| 244 | V244 | V244 | V244 | V32 + (V244 − V243) | V32 + (V244 − V243) | V32 + (V244 − V243) |
| 245 | V245 | V245 | V245 | V32 + (V245 − V244) | V32 + (V245 − V244) | V32 + (V245 − V244) |
| 246 | V246 | V246 | V246 | V32 + (V246 − V245) | V32 + (V246 − V245) | V32 + (V246 − V245) |
| 247 | V247 | V247 | V247 | V32 + (V247 − V246) | V32 + (V247 − V246) | V32 + (V247 − V246) |
| 248 | V248 | V248 | V248 | V32 + (V248 − V247) | V32 + (V248 − V247) | V32 + (V248 − V247) |
| 249 | V249 | V249 | V249 | V32 + (V249 − V248) | V32 + (V249 − V248) | V32 + (V249 − V248) |
| 250 | V250 | V250 | V250 | V32 + (V250 − V249) | V32 + (V250 − V249) | V32 + (V250 − V249) |
| 251 | V251 | V251 | V251 | V32 + (V251 − V250) | V32 + (V251 − V250) | V32 + (V251 − V250) |
| 252 | V252 | V252 | V252 | V32 + (V252 − V251) | V32 + (V252 − V251) | V32 + (V252 − V251) |
| 253 | V253 | V253 | V253 | V32 + (V253 − V252) | V32 + (V253 − V252) | V32 + (V253 − V252) |
| 254 | V254 | V254 | V254 | V32 + (V254 − V253) | V32 + (V254 − V253) | V32 + (V254 − V253) |
| 255 | V255 | V255 | V255 | V255 | V255 | V255 |

The color with the most severe color cast is selected as the target color scheme, and the other color schemes keep the original input signal:

According to FIG. 1, FIG. 2, and FIG. 3, the color with the most severe color cast is color B, and the color cast gray scale display voltages are from V0 to V59. The parts of the original gray scale display voltages that are less than the color cast gray scale displays voltage are deleted, then the obtained map gray scale display voltages are from V60 to V255. For other color schemes in the input signal, the original input signal is kept, then the original gray scale display voltages from V0 to V255 are redistributed to the map gray scale display voltages. The following TABLE 4 can be referred to for details.

TABLE 4 is the relationship between the original gray scale display voltage of each of the color schemes and the map gray scale display voltage while color B is the target color scheme and the other color schemes keep the original input signal.

| Input signal | Original gray scale display voltage R | G | B | Map gray scale display voltage R | G | B |
|---|---|---|---|---|---|---|
| 0 | V0 | V0 | V0 | V0 | V0 | V60 |
| 1 | V1 | V1 | V1 | V1 | V1 | V60 + (V1 − V0) |
| 2 | V2 | V2 | V2 | V2 | V2 | V60 + (V2 − V1) |
| 3 | V3 | V3 | V3 | V3 | V3 | V60 + (V3 − V2) |
| 4 | V4 | V4 | V4 | V4 | V4 | V60 + (V4 − V3) |
| 5 | V5 | V5 | V5 | V5 | V5 | V60 + (V5 − V4) |
| 6 | V6 | V6 | V6 | V6 | V6 | V60 + (V6 − V5) |
| 7 | V7 | V7 | V7 | V7 | V7 | V60 + (V7 − V6) |
| 8 | V8 | V8 | V8 | V8 | V8 | V60 + (V8 − V7) |
| 9 | V9 | V9 | V9 | V9 | V9 | V60 + (V9 − V8) |
| . | . | . | . | . | . | . |
| . | . | . | . | . | . | . |
| . | . | . | . | . | . | . |
| 244 | V244 | V244 | V244 | V244 | V244 | V60 + (V244 − V243) |
| 245 | V245 | V245 | V245 | V245 | V245 | V60 + (V245 − V244) |
| 246 | V246 | V246 | V246 | V246 | V246 | V60 + (V246 − V245) |
| 247 | V247 | V247 | V247 | V247 | V247 | V60 + (V247 − V246) |
| 248 | V248 | V248 | V248 | V248 | V248 | V60 + (V248 − V247) |
| 249 | V249 | V249 | V249 | V249 | V249 | V60 + (V249 − V248) |
| 250 | V250 | V250 | V250 | V250 | V250 | V60 + (V250 − V249) |
| 251 | V251 | V251 | V251 | V251 | V251 | V60 + (V251 − V250) |

-continued

| Input signal | Original gray scale display voltage R | G | B | Map gray scale display voltage R | G | B |
|---|---|---|---|---|---|---|
| 252 | V252 | V252 | V252 | V252 | V252 | V60 + (V252 − V251) |
| 253 | V253 | V253 | V253 | V253 | V253 | V60 + (V253 − V252) |
| 254 | V254 | V254 | V254 | V254 | V254 | V60 + (V254 − V253) |
| 255 | V255 | V255 | V255 | V255 | V255 | V255 |

The colors to be improved includes the color with the most severe color cast and the color with the second severe color cast, and the other color schemes keep the original input signal:

According to FIG. 1, FIG. 2, and FIG. 3, the color with the most severe color cast is color B, the color with the second severe color cast is color R, and the color cast gray scale display voltages of color B are from V0 to V59. The parts of color cast grayscales in the original gray scale display voltages from V0 to V255 are deleted, then the obtained map gray scale display voltages of color B are from V60 to V255. The color cast gray scale display voltages of color R are from V0 to V55, the part of color cast gray scales in the original gray scale display voltages from V0 to V255 are deleted, then the obtained map gray scale display voltages are from V56 to V255. For other color schemes in the input signal, the original input signal is kept, then for color B the original gray scale display voltages from V0 to V255 are redistributed to the map gray scale display voltage V60 to V255, and for color R the original gray scale display voltages from V0 to V255 are redistributed to the map gray scale display voltages from V56 to V255. The following TABLE 5 can be referred to for details.

TABLE 5 is the relationship between the original gray scale display voltage of each of the color schemes and the map gray scale display voltage while color B with the most severe color cast and color R with the second most severe color cast are the target color schemes.

| Input signal | Original gray scale display voltage R | G | B | Map gray scale display voltage R | G | B |
|---|---|---|---|---|---|---|
| 0 | V0 | V0 | V0 | V56 | V0 | V60 |
| 1 | V1 | V1 | V1 | V56 + (V1 − V0) | V1 | V60 + (V1 − V0) |
| 2 | V2 | V2 | V2 | V56 + (V2 − V1) | V2 | V60 + (V2 − V1) |
| 3 | V3 | V3 | V3 | V56 + (V3 − V2) | V3 | V60 + (V3 − V2) |
| 4 | V4 | V4 | V4 | V56 + (V4 − V3) | V4 | V60 + (V4 − V3) |
| 5 | V5 | V5 | V5 | V56 + (V5 − V4) | V5 | V60 + (V5 − V4) |
| 6 | V6 | V6 | V6 | V56 + (V6 − V5) | V6 | V60 + (V6 − V5) |
| 7 | V7 | V7 | V7 | V56 + (V7 − V6) | V7 | V60 + (V7 − V6) |
| 8 | V8 | V8 | V8 | V56 + (V8 − V7) | V8 | V60 + (V8 − V7) |
| 9 | V9 | V9 | V9 | V56 + (V9 − V8) | V9 | V60 + (V9 − V8) |
| . | . | . | . | . | . | . |
| . | . | . | . | . | . | . |
| . | . | . | . | . | . | . |
| 244 | V244 | V244 | V244 | V56 + (V244 − V243) | V244 | V60 + (V244 − V243) |
| 245 | V245 | V245 | V245 | V56 + (V245 − V244) | V245 | V60 + (V245 − V244) |
| 246 | V246 | V246 | V246 | V56 + (V246 − V245) | V246 | V60 + (V246 − V245) |
| 247 | V247 | V247 | V247 | V56 + (V247 − V246) | V247 | V60 + (V247 − V246) |
| 248 | V248 | V248 | V248 | V56 + (V248 − V247) | V248 | V60 + (V248 − V247) |
| 249 | V249 | V249 | V249 | V56 + (V249 − V248) | V249 | V60 + (V249 − V248) |
| 250 | V250 | V250 | V250 | V56 + (V250 − V249) | V250 | V60 + (V250 − V249) |
| 251 | V251 | V251 | V251 | V56 + (V251 − V250) | V251 | V60 + (V251 − V250) |
| 252 | V252 | V252 | V252 | V56 + (V252 − V251) | V252 | V60 + (V252 − V251) |
| 253 | V253 | V253 | V253 | V56 + (V253 − V252) | V253 | V60 + (V253 − V252) |
| 254 | V254 | V254 | V254 | V56 + (V254 − V253) | V254 | V60 + (V254 − V253) |
| 255 | V255 | V255 | V255 | V255 | V255 | V255 |

Figure 5:
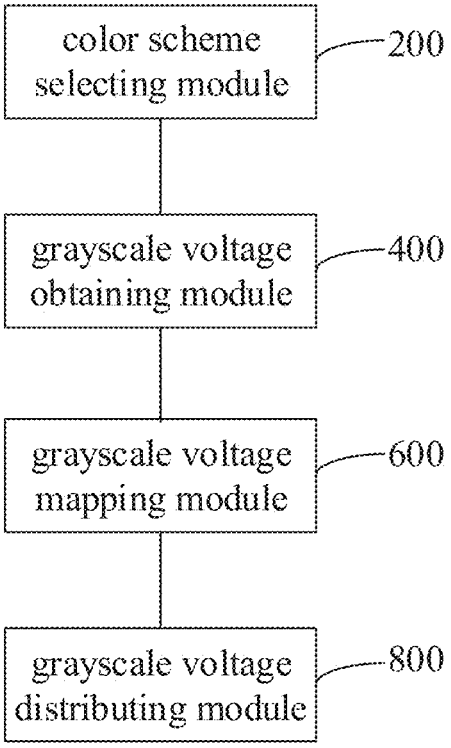
FIG. 5 is a schematic structure of a driving apparatus for a display apparatus according to an embodiment of the present disclosure.

A driving apparatus for a display apparatus according to FIG. 5, includes:

a color scheme selecting module 200 configured to acquire a color scheme to be adjusted;

a gray scale voltage acquiring module 400 configured to acquire original gray scale display voltages corresponding to the target color scheme in an input signal and color cast gray scale display voltages corresponding to a color cast generated in the target color scheme;

a gray scale voltage mapping module 600 configured to delete parts of the original gray scale display voltages that are less than the color cast gray scale display voltages, thus obtain map gray scale display voltages corresponding to the target color scheme; and a gray scale voltage distributing module 800 configured to distribute the original gray scale display voltages corresponding to the target color scheme to the map gray scale display voltages corresponding to the target color scheme.

The driving apparatus for the display apparatus according to present disclosure, the color scheme selecting module 200 acquires the target color scheme to be adjusted; the gray scale voltage acquiring module 400 acquires the original gray scale display voltages corresponding to the target color scheme in the input signal and the color cast gray scale display voltages corresponding to the color cast generated in the target color scheme; the gray scale voltage mapping module 600 deletes the part of the original gray scale display voltages that are less than the color cast gray scale display voltages, thus obtains the map gray scale display voltages corresponding to the target color scheme; and the gray scale voltages distributing module 800 distributes the original gray scale display voltages corresponding to the target color scheme to the map gray scale display voltages corresponding to the target color scheme. During the whole progress, the low gray scales that affect the color brightness in the target color scheme are deleted, such that the color casted image quality for the display apparatus is effectively improved.

According to an embodiment, the color scheme selecting module 200 includes:

an acquiring unit configured to acquire the color cast data corresponding to each of the color schemes in the input signal;

a selecting unite configured to regard a color with the smallest color cast value as the target color scheme, or configured to regard the color with the greatest color cast value as the target color scheme, or configured to regard color with the greatest color cast value and the color with the second greatest color cast value as the target color scheme.

According to an embodiment, the gray scale voltage acquiring module 400 is further configured to acquire the chroma variation profile of the target color scheme, and acquire the color cast gray scale display voltages corresponding to a color cast generated in the target color scheme according to the chroma variation profile.

Figure 6:
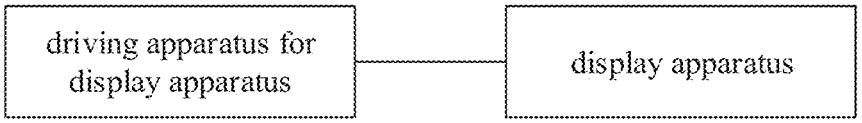
FIG. 6 is a block diagram of a display apparatus for a driving method and a driving apparatus to according to an embodiment of the present disclosure.

It is to be understood that the driving method and apparatus for a display apparatus can be applied to various types of display apparatus, as FIG. 6 indicated. Specifically, the display apparatus can be any type of display apparatus, such as an LCD apparatus, an Organic Electroluminescence Display (OLED) apparatus, a Quantum Dot Light Emitting Diodes (QLED) display apparatus or a curved display apparatus.

Although the present disclosure is illustrated and described herein with reference to specific embodiments, the invention is not intended to be limited to the details shown. Rather, various modifications may be made in the details within the scope and range of equivalents of the claims and without departing from the invention.

What is claimed is:

1. A driving method for a display apparatus, comprising:

acquiring a target color scheme to be adjusted;

acquiring original gray scale display voltages corresponding to the target color scheme in an input signal;

acquiring a chroma variation profile of the target color scheme;

acauiring color cast gray scale display voltages corresponding to a color cast generated in the target color scheme and according to the chroma variation profile;

deleting parts of the original gray scale display voltages corresponding to the target color scheme and less than the color cast gray scale display voltages, thus obtaining map gray scale display voltages corresponding to the target color scheme; and distributing the original gray scale display voltages corresponding to the target color scheme to the map gray scale display voltages corresponding to the target color scheme.

2. The driving method for the display apparatus according to claim 1, wherein the target color scheme is a solid color;

wherein prior to the step of distributing the original gray scale display voltages corresponding to the target color scheme to the map gray scale display voltages corresponding to the target color scheme, the method further comprises:

acquiring the original gray scale display voltages corresponding to each color scheme;

deleting parts of the original gray scale display voltages corresponding to each of the color schemes and less than the color cast gray scale display voltages, thus obtaining map gray scale display voltages corresponding to each of the color schemes;

wherein the step of distributing the original gray scale display voltages corresponding to the target color scheme to the map gray scale display voltages corresponding to the target color scheme comprises:

distributing the original gray scale display voltages corresponding to each of the color schemes to the map gray scale display voltages corresponding to each of the color schemes.

3. The driving method for the display apparatus according to claim 1, wherein the target color scheme is a solid color;

wherein prior to the step of distributing the original gray scale display voltages corresponding to the target color scheme to the map gray scale display voltages corresponding to the target color scheme, the method further comprises:

acquiring the original gray scale display voltages corresponding to each of the color schemes;

deleting parts of the original gray scale display voltages corresponding to each of the color schemes and less than the color cast gray scale display voltage, thus obtaining map gray scale display voltages corresponding to each of the color schemes; and wherein the step of distributing the original gray scale display voltages corresponding to the target color scheme to the map gray scale display voltages corresponding to the target color scheme comprises:

distributing the original gray scale display voltages corresponding to each of the color schemes to the map gray scale display voltages corresponding to each of the color schemes.

4. The driving method for the display apparatus according to claim 1, wherein an increased display voltage for each gray scale in the map gray scale display voltages corresponding to the target color scheme is a difference of the display voltages between a current gray scale and a previous gray scale in the original gray scale corresponding to the target color scheme.

5. The driving method for the display apparatus according to claim 1, wherein the step of acquiring the target color scheme to be adjusted comprises:

acquiring color cast data corresponding to each color scheme in the input signal; and regarding a color with a greatest color cast value as the target color scheme.

6. The driving method for the display apparatus according to claim 5, wherein the target color scheme is a solid color;

wherein prior to the step of distributing the original gray scale display voltages corresponding to the target color scheme to the map gray scale display voltages corresponding to the target color scheme, the method further comprises:

acquiring the original gray scale display voltages corresponding to each of the color schemes;

deleting parts of the original gray scale display voltages corresponding to each of the color schemes and less than the color cast gray scale display voltages, thus obtaining map gray scale display voltages corresponding to each of the color schemes;

wherein the step of distributing the original gray scale display voltages corresponding to the target color scheme to the map gray scale display voltages corresponding to the target color scheme comprises:

distributing the original gray scale display voltages corresponding to each of the color schemes to the map gray scale display voltages corresponding to each of the color schemes.

7. The driving method for the display apparatus according to claim 1, wherein the step of acquiring the target color scheme to be adjusted comprises:

acquiring color cast data corresponding to each color scheme in the input signal; and regarding a color with a smallest color cast value as the target color scheme.

8. The driving method for the display apparatus according to claim 7, wherein the target color scheme is a solid color;

wherein prior to the step of distributing the original gray scale display voltages corresponding to the target color scheme to the map gray scale display voltages corresponding to the target color scheme further comprises:

acquiring the original gray scale display voltages corresponding to each of the color schemes;

deleting parts of the original gray scale display voltages corresponding to each of the color schemes and less than the color cast gray scale display voltages, thus obtaining map gray scale display voltages corresponding to each of the color schemes; and wherein the step of distributing the original gray scale display voltages corresponding to the target color scheme to the map gray scale display voltages corresponding to the target color scheme comprises:

distributing the original gray scale display voltages corresponding to each of the color schemes to the map gray scale display voltages corresponding to each of the color schemes.

9. The driving method for the display apparatus according to claim 1, wherein the step of acquiring the target color scheme to be adjusted comprises:

acquiring color cast data corresponding to each color scheme in the input signal; and regarding a color with the greatest color cast value and a color with the second greatest color cast value as the target color scheme.

10. The driving method for the display apparatus according to claim 9, wherein the target color scheme is a solid color;

wherein prior to the step of distributing the original gray scale display voltages corresponding to the target color scheme to the map gray scale display voltages corresponding to the target color scheme, the method further comprises:

acquiring the original gray scale display voltages corresponding to each of the color schemes;

deleting parts of the original gray scale display voltages corresponding to each of the color schemes and less than the color cast gray scale display voltages, thus obtaining map gray scale display voltages corresponding to each of the color schemes; and wherein the step of distributing the original gray scale display voltages corresponding to the target color scheme to the map gray scale display voltages corresponding to the target color scheme comprises:

distributing the original gray scale display voltages corresponding to each of the color schemes to the map gray scale display voltages corresponding to each of the color schemes.

11. A driving apparatus for a display apparatus, comprising:

a color scheme selecting module configured to acquire a target color scheme to be adjusted;

a gray scale voltage acquiring module configured to acquire original gray scale display voltages corresponding to the target color scheme in an input signal, acquire a chroma variation profile of the target color scheme, and acquire color cast gray scale display voltages corresponding to a color cast generated in the target color scheme according to the chroma variation profile;

a gray scale voltage mapping module configured to delete parts of the original gray scale display voltages corresponding to the target color scheme and less than the color cast gray scale display voltages, thus obtain map gray scale display voltages corresponding to the target color scheme; and a gray scale voltage distributing module configured to distribute the original gray scale display voltages corresponding to the target color scheme to the map gray scale display voltages corresponding to the target color scheme.

12. The driving apparatus for the display apparatus according to claim 11, wherein the target color scheme is a solid color;

wherein the gray scale voltage mapping module is configured to acquire the original gray scale display voltages corresponding to each color scheme in the input signal, delete the parts of the original gray scale display voltages corresponding to each of the color schemes and less than the color cast gray scale display voltages, thus obtain the map gray scale display voltages corresponding to each of the color schemes; and wherein the gray scale voltage mapping module is configured to distribute the original gray scale display voltages corresponding to each of the color schemes to the map gray scale display voltages corresponding to each of the color schemes.

13. The driving apparatus for the display apparatus according to claim 11, wherein the color scheme selecting module comprises:

an acquiring unit configured to acquire color cast data corresponding to each color scheme in the input signal; and a selecting unite configured to regard a color with the least color cast value as the target color scheme.

14. The driving apparatus for the display apparatus according to claim 11, wherein the color scheme selecting module comprises:

an acquiring unit configured to acquire color cast data corresponding to each color scheme in the input signal; and a selecting unite configured to regard a color with the greatest color cast value as the target color scheme.

15. The driving apparatus for the display apparatus according to claim 11, wherein the color scheme selecting module comprises:

an acquiring unit configured to acquire color cast data corresponding to each color scheme in the input signal; and a selecting unite configured to regard a color with the greatest color cast value and a color with the second greatest color cast value as the target color scheme.

16. The driving apparatus for the display apparatus according to claim 11, wherein the target color scheme is a solid color;

wherein the gray scale voltage mapping module is configured to acquire the original gray scale display voltages corresponding to each color scheme, delete the parts of the original gray scale display voltages corresponding to each of the color schemes and less than the color cast gray scale display voltages, thus obtain map gray scale display voltages corresponding to each of the color schemes; and wherein the gray scale voltage mapping module is configured to distribute the original gray scale display voltages corresponding to each of the color schemes to the map gray scale display voltages corresponding to each of the color schemes.

17. The driving apparatus for the display apparatus according to claim 11, wherein an increased display voltage for each gray scale in the map gray scale voltage corresponding to the target scheme is a difference of the display voltages between a current gray scale and a previous gray scale in the original gray scale corresponding to the target color scheme.

18. A driving method for a display apparatus, comprising:

acquiring color cast data corresponding to each color scheme in an input signal;

regarding a color with a least color cast value as a target color scheme, or, regarding a color with a greatest color cast value as a target color scheme, or regarding a color with the greatest color cast value and a color with the second greatest color cast value as target color schemes, and the target color scheme is a solid color;

acquiring original gray scale display voltages corresponding to the target color scheme in an input signal;

acauiring a chroma variation profile of the target color scheme;

acauiring color cast gray scale display voltages corresponding to a color cast generated in the target color scheme and according to the chroma variation profile;

acquiring original gray scale display voltages corresponding to each of the color schemes in the input signal;

deleting parts of the original gray scale display voltages corresponding to the each of the color schemes and less than the color cast gray scale display voltages, thus obtaining map gray scale display voltages corresponding to each of the color schemes; and distributing the original gray scale display voltages corresponding to each of the color schemes to the map gray scale display voltages, wherein an increased display voltage in the map gray scale display voltages corresponding to the target color scheme is a difference of the display voltages between the current gray scale and the previous gray scale in the original gray scale corresponding to the target color scheme.

* * * * *